US010125497B2

(12) United States Patent
Givens

(10) Patent No.: US 10,125,497 B2
(45) Date of Patent: Nov. 13, 2018

(54) CONTINUOUS ONE-PIECE FLASHING

(71) Applicant: Robert D. Givens, Tellico Plains, TN (US)

(72) Inventor: Robert D. Givens, Tellico Plains, TN (US)

(73) Assignee: Dryflekt, Inc., Grantham, NH (US)

( * ) Notice: Subject to any disclaimer, the term of this patent is extended or adjusted under 35 U.S.C. 154(b) by 0 days.

(21) Appl. No.: 14/750,593

(22) Filed: Jun. 25, 2015

(65) Prior Publication Data

US 2016/0376791 A1 Dec. 29, 2016

(51) Int. Cl.

| | |
|---|---|
| ***E04B 1/66*** | (2006.01) |
| ***E04D 13/04*** | (2006.01) |
| ***E04D 13/147*** | (2006.01) |

(52) U.S. Cl.

CPC ..... *E04D 13/1478* (2013.01); *E04B 1/665* (2013.01); *E04D 2013/045* (2013.01)

(58) Field of Classification Search

CPC ..... E04D 13/1478; E04D 13/0445; E04D 13/1415; E04B 1/665; E04B 1/644

See application file for complete search history.

(56) References Cited

U.S. PATENT DOCUMENTS 848,075 A * 3/1907 Wainwright ..... E04F 11/163 404/19
1,685,525 A * 9/1928 Dow ..... E04D 13/1415 52/58
1,860,240 A * 5/1932 Friedrich ..... E04D 13/1415 52/300
D110,435 S * 7/1938 Lowry ..... D25/119
D115,247 S * 6/1939 Bonnell ..... 52/716.1
2,244,970 A * 6/1941 Soucy ..... E04D 13/1415 52/300
2,358,396 A * 9/1944 Hogan ..... E04D 3/38 52/394
2,705,820 A * 4/1955 Torrence ..... A47B 13/083 108/27
3,092,869 A * 6/1963 Stump ..... A47G 27/0456 16/7
3,126,444 A * 3/1964 Taylor ..... H02G 3/0418 138/163
3,388,510 A * 6/1968 Smith ..... E04F 10/08 52/15
3,603,054 A * 9/1971 Didry ..... E04B 2/7854 52/280
3,719,013 A * 3/1973 Blick ..... E04B 9/303 160/371

(Continued)

OTHER PUBLICATIONS

DryFlekt—Kick-Out Diverters www.dryflekt.com 2012 DryFlekt pp. 2.

(Continued)

*Primary Examiner* — Charles A Fox
*Assistant Examiner* — Charissa Ahmad
(74) *Attorney, Agent, or Firm* — St. Onge Steward Johnston & Reens, LLC

(57) ABSTRACT

A continuous, one-piece flashing with an upper panel and a lower panel adapted to seal a multi-surface intersection, such as between a wall and a roof. The flashing includes protrusions for improving the ease of installation of wall-coverings and/or protection from water infiltration.

19 Claims, 5 Drawing Sheets

(56) References Cited

U.S. PATENT DOCUMENTS 3,783,931 A * 1/1974 Assael ..... A47H 1/18 160/327
3,834,104 A * 9/1974 Dunn ..... E04D 13/155 52/376
3,855,746 A * 12/1974 Leggiere ..... E04F 19/061 52/213
D240,707 S * 7/1976 Rudinski ..... D25/122
D243,730 S * 3/1977 Koenig ..... D25/123
4,166,195 A * 8/1979 Schwab ..... H02G 5/06 174/101
D253,130 S * 10/1979 Broadbent ..... D12/414
D253,131 S * 10/1979 Broadbent ..... D25/125
4,332,117 A * 6/1982 Quinnell ..... E04D 13/1585 52/94
4,586,841 A * 5/1986 Hunter ..... E04B 9/127 403/230
4,706,421 A * 11/1987 Thompson ..... E04D 13/1585 52/58
4,869,032 A * 9/1989 Geske ..... E02D 31/02 405/43
4,912,900 A * 4/1990 Yeamans ..... E04D 13/1415 160/395
4,951,431 A 8/1990 Sweers
5,003,732 A * 4/1991 Quinnell ..... E04D 13/0641 52/748.1
5,003,743 A * 4/1991 Bifano ..... E04F 13/06 52/288.1
5,024,614 A * 6/1991 Dola ..... H02G 3/128 174/486
5,025,604 A * 6/1991 Yeamans ..... E04D 13/1415 52/273
D318,343 S * 7/1991 Miller ..... D13/155
D320,094 S * 9/1991 Miller ..... D13/155
5,058,340 A * 10/1991 Muller ..... E04B 9/303 160/395
5,089,667 A * 2/1992 Goussin ..... H02G 3/0437 138/117
5,109,641 A * 5/1992 Halan ..... E04D 13/1478 52/276
D342,326 S * 12/1993 Hansson ..... D25/119
D342,579 S * 12/1993 Mason ..... D25/119
5,289,663 A * 3/1994 Schluter ..... E04F 15/02027 52/287.1
5,333,419 A * 8/1994 Hickner ..... E04D 13/04 52/13
5,336,849 A * 8/1994 Whitney ..... E04F 17/08 174/101
5,337,526 A 8/1994 Hartman
D354,733 S * 1/1995 Ingraham ..... D13/155
5,423,154 A * 6/1995 Maylon ..... E04F 13/06 52/364
5,433,048 A * 7/1995 Strasser ..... E04F 19/0436 52/288.1
5,522,189 A * 6/1996 Mortensen ..... E04D 13/02 52/200
5,531,050 A * 7/1996 Stibolt ..... E04B 2/82 52/254
5,579,617 A * 12/1996 Schiedegger ..... E04F 19/02 52/287.1
5,894,697 A 4/1999 Hunter
5,946,862 A 9/1999 Hoffman
6,186,605 B1 * 2/2001 Nelson ..... A47B 77/022 312/140.4
D438,650 S * 3/2001 Neuhofer, Jr. ..... D25/199
6,260,321 B1 * 7/2001 Rudduck ..... E04B 2/7455 52/281
6,308,470 B1 * 10/2001 Durkovic ..... E02D 27/02 405/36
6,421,964 B1 * 7/2002 Schiedegger ..... E04D 13/158 52/287.1
6,485,663 B1 * 11/2002 Dover ..... B60J 10/79 264/173.17
6,598,362 B2 * 7/2003 Hikai ..... E04F 13/0864 52/235
6,615,560 B2 * 9/2003 Ito ..... E04F 13/0846 248/220.21
6,681,530 B1 1/2004 Givens
D489,463 S * 5/2004 Barnett ..... D25/119
6,735,917 B1 * 5/2004 Notermann ..... B62D 27/026 52/653.1
6,786,011 B2 9/2004 Mares
6,880,302 B1 * 4/2005 Fontaine ..... B44C 7/022 160/371
D518,186 S * 3/2006 Zarb ..... D25/119
D539,753 S * 4/2007 Makwinski ..... D13/155
D539,755 S * 4/2007 Makwinski ..... D13/155
7,290,373 B2 11/2007 Austin et al.
D583,649 S * 12/2008 Parker ..... D8/349
7,621,079 B2 * 11/2009 Takagi ..... E04B 1/70 52/100
7,685,779 B1 * 3/2010 Nelson ..... E04D 1/36 52/58
7,712,271 B2 * 5/2010 Harrison ..... E04F 19/022 52/254
7,721,488 B1 5/2010 Bennett
7,836,658 B2 11/2010 Perrot, Jr.
7,997,027 B1 * 8/2011 Mischo ..... E04D 11/002 47/65.5
D652,569 S * 1/2012 Trzesniowski ..... D26/138
8,171,685 B2 * 5/2012 Harrison ..... E04F 19/022 52/254
D661,819 S * 6/2012 Rider ..... D25/119
8,387,337 B2 * 3/2013 Hamlin, III ..... E04D 13/1415 52/300
8,468,750 B2 6/2013 Clearfield et al.
8,522,508 B1 9/2013 Collins
8,578,660 B2 11/2013 Nolan et al.
D700,717 S * 3/2014 Campacci ..... D25/119
8,850,751 B2 * 10/2014 Makin ..... E04D 13/1478 52/58
D720,473 S * 12/2014 Knox ..... D25/119
D769,460 S * 10/2016 Mumford, Sr. ..... D25/119
2002/0043029 A1 * 4/2002 Hikai ..... E04F 13/0846 52/58
2003/0089552 A1 * 5/2003 Sahawneh ..... E04D 5/10 182/1
2003/0177712 A1 * 9/2003 Gatherum ..... E04B 1/70 52/60
2004/0074188 A1 * 4/2004 Beck ..... E04F 13/0841 52/522
2005/0086873 A1 4/2005 Mares
2005/0183345 A1 * 8/2005 Allen ..... E04D 13/1478 52/58
2006/0037263 A1 * 2/2006 Hacker, Jr. ..... E04F 19/04 52/211
2006/0207793 A1 * 9/2006 Stempinski ..... H02G 3/105 174/481
2006/0254169 A1 * 11/2006 McFadden ..... E04F 13/06 52/344
2007/0163187 A1 * 7/2007 Price ..... E02D 29/025 52/169.12
2008/0104918 A1 * 5/2008 Gleeson ..... E04B 1/74 52/489.1
2008/0209834 A1 * 9/2008 Ouellette ..... E04F 13/0889 52/518
2009/0277102 A1 * 11/2009 Bishop ..... E04D 3/38 52/58
2010/0132295 A1 * 6/2010 Bootier ..... E04F 13/18 52/520
2013/0192145 A1 * 8/2013 Hoch ..... E04D 13/1475 52/58

OTHER PUBLICATIONS

DryFlekt Postcard DryFlekt, Inc. www.DryFlekt.com pp. 2.
Flashing Products—Toolbase Services <http://www.toolbase.org/Building-Systems/Doors/flashing-products> Mar. 26, 2010 pp. 2.

(56) References Cited

OTHER PUBLICATIONS

Roof-to-Wall Flashing DryFlekt Products, Inc. www.DryFlekt.com pp. 2.
Sheets Regarding Roof Installation South Pacific Shingles(2003)Ltd New Zealand; 2003; Viking Roofspec Ltd <www.Vikingroofspec.co.nz> pp. 4.
U.S. Department of Energy—Energy Efficiency & Renewable Energy—Building Technologies Program; PNNL-SA-83157; Sep. 2011; pp. 2.

* cited by examiner

CONTINUOUS ONE-PIECE FLASHING

FIELD OF THE INVENTION

This invention relates to one-piece flashings pre-formed to fit against building surfaces at multi-surface intersections. In particular, the flashing is intended to fit at the joint between a wall and a roof, where the possibility of water infiltration has previously been especially likely to occur.

BACKGROUND OF THE INVENTION

Standard practice to prevent water infiltration at an intersection of multiple surfaces on structures like houses and other buildings has been to create rigid, multi-piece flashings on the job by bending pieces of sheet metal during the construction or repair of such structures. The assembled flashings are then fitted against the intersecting building surfaces with at least part of at least one of the sheet metal pieces overlapping part of another. The joints between overlapping pieces are sealed by caulking material or the like. Construction of these multi-piece flashings is time-consuming, difficult to do, and expensive. In some instances, each piece of flashing is no more than 12 inches long, which entails handling a large number of flashing pieces and a creating a large number of caulk seals between them to complete an installation.

The use of multi-piece flashings presents serious problems. Over a period of time, caulking tends to break down and lose its adhesion to the surface with which it was intended to bond. This breakdown can occur at any time, and it is not uncommon for it to occur within four or five years from the date the caulking was applied. If that happens and a substantial amount of moisture works its way into the building as a result, the damage to the building can be substantial. The seriousness of this problem is magnified for multi-piece flashings due to the high number of caulk seals. There are a large number of potential failure points and a large number of seals to be replaced.

What is needed, therefore, is a flashing product that is easier and less cost intensive to manufacture, easier and less cost intensive to install, and that improves on the water protection properties of multi-piece flashing products. Further, what is needed is a flashing product that does not degrade significantly over time after installation. Even further, what is desired is a flashing product that makes the process of completing the construction of the structure easier. Additionally, what is needed is a flashing product that provides improved control of moisture that may intrude at the junction of a roof and wall and improved prevention of water damage to the underlying building structure.

SUMMARY OF THE INVENTION

It is an object of the present invention to provide flashing that is easier and less cost intensive to manufacture and install.

It is another object to provide flashing that does not degrade significantly over time after installation.

A further object is to provide flashing that improves on the water protection properties of multi-piece flashing products and the sealants and/or caulking at used at the joints between flashing products.

Another object is to provide flashing that makes the process of completing the construction of the structure easier.

Yet another object of the present invention is to provide flashing with improved control of moisture that may intrude at the junction of a roof and/or wall and improved prevention of water damage to the underlying building structure.

These and other objects are at least partially obtained by use of the present invention.

According to a first embodiment of the present invention, a flashing is provided. The flashing comprises an upper panel having a longitudinal axis and a first upper surface; a lower panel arranged at an angle with respect to the upper panel and having a first lower surface; at least one first protrusion protruding from the first upper surface of the upper panel; and at least one second protrusion protruding from the first lower surface. The flashing is formed as a single-piece component.

In some embodiments, the flashing further comprises a plurality of holes in one or more of the upper panel and the lower panel for fastening the flashing to at least one surface. In some embodiments, the flashing further comprises that the first protrusion extends along the longitudinal axis from a first edge of the upper panel to a second edge of the upper panel. In some embodiments, the flashing further comprises that the second protrusion extends along the longitudinal axis from a first edge of the lower panel to a second edge of the lower panel.

In some embodiments, the flashing further comprises that the first protrusion forms a ledge and protrudes from the first upper surface at an angle of less than 90°. In some embodiments, the flashing further comprises that the second protrusion has substantially the shape of a "T" when viewed along the longitudinal axis. In some embodiments, the flashing further comprises that the second protrusion is located at about 6/7ths of the distance from the first upper surface to a third edge of the lower panel.

In some embodiments, the flashing further comprises that it is formed of a flexible polymer material. In some embodiments, the tensile strength of the flexible polymer material is about 1500 psi when determined according to ASTM Standard D412-06, method A, Die C. In some embodiments, the tear strength of the flexible polymer is about 730 pounds per inch when determined according to ASTM Standard D624-12, Die C. In some embodiments, the flexible polymer will not absorb any substantial amount of water. In some embodiments, the flashing further comprises that the upper panel and the lower panel are arranged at about a 90° angle.

According to a second embodiment of the present invention, a flashing is provided that comprises an upper panel having a longitudinal axis and a first upper surface; a lower panel arranged at an angle with respect to the upper panel and having a first lower surface; at least one substantially "T"-shaped protrusion protruding from the first lower surface; and where the flashing is formed of a flexible polymer material. The flashing is formed as a single-piece component.

In some embodiments, the flashing further comprises that the substantially "T"-shaped protrusion is located at about 6/7ths of the distance from the first upper surface to an edge of the lower panel that is substantially parallel to the longitudinal axis. In some embodiments, the flashing further comprises a second protrusion protruding from the first upper surface of the upper panel. In some embodiments, the flashing further comprises that the second protrusion has substantially the shape of an "L" when viewed along the longitudinal axis. In some embodiments, the flashing further comprises that the second protrusion forms a ledge and protrudes from the first upper surface at an angle of less than 90°. In some embodiments, the tensile strength of the flexible polymer material is about 1500 psi when determined according to ASTM Standard D412-06, method A, Die C. In some embodiments, the tear strength of the flexible polymer is about 730 pounds per inch when determined according to ASTM Standard D624-12, Die C. In some embodiments, the flexible polymer will not absorb any substantial amount of water.

According to a third embodiment of the present invention, a method of installing flashing is provided. The method comprises the steps of: joining a first flashing comprising an upper panel, a lower panel, at least one first protrusion protruding from the upper panel, and at least one second protrusion protruding from the lower panel to a second flashing by heat welding; positioning the first flashing and the second flashing adjacent to a joint between a wall and a roof; fastening the first flashing and the second flashing to one or both of the wall and the roof; installing at least one wall covering over at least a portion of the upper panel of the first flashing such that the wall covering abuts the first protrusion; installing at least one roof covering over at least a portion of the lower panel of the first flashing, including over the second protrusion.

Exemplary embodiment(s) of the invention will now be described in greater detail in connection with the following drawings.

DETAILED DESCRIPTION OF THE INVENTION

Figure 1:
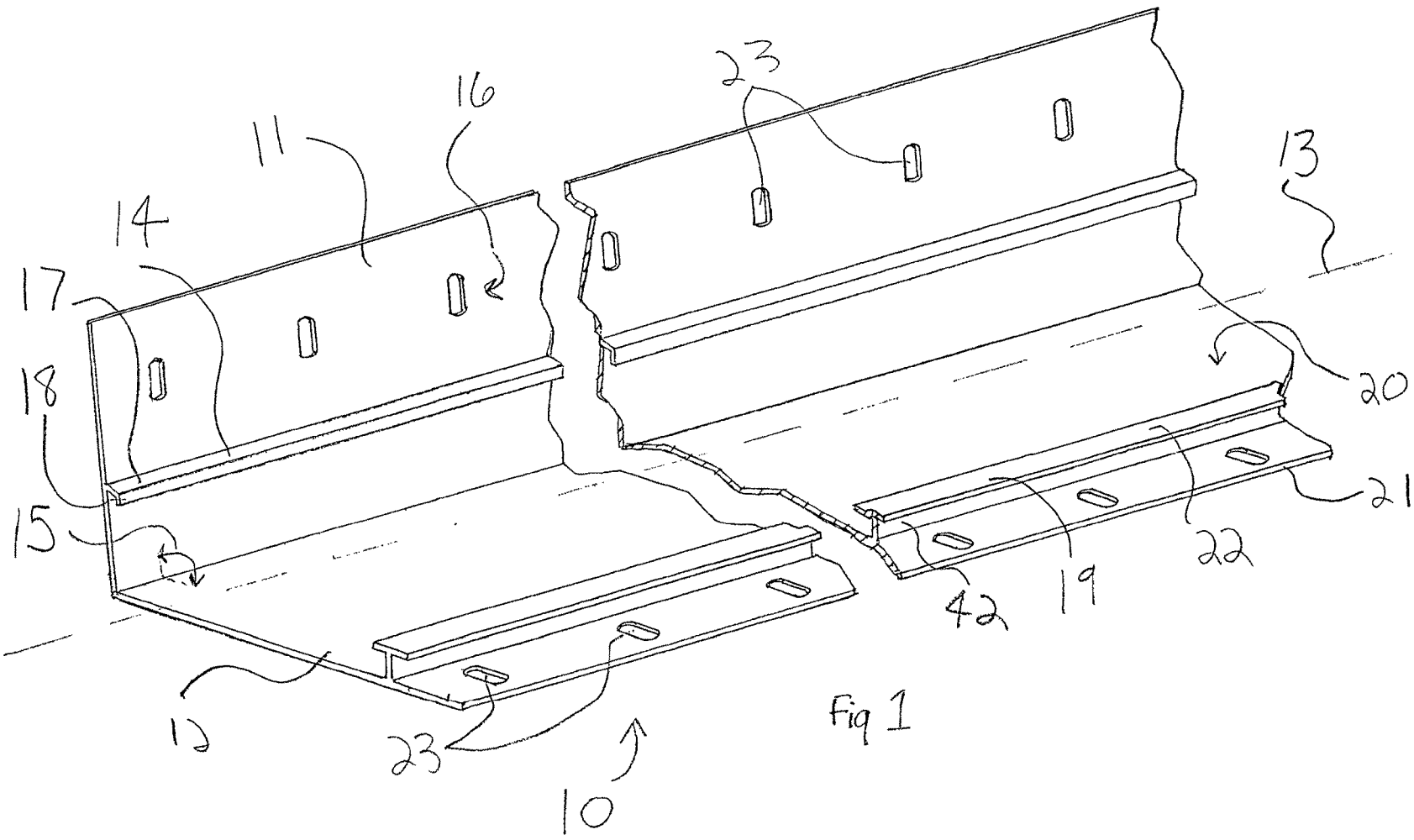
FIG. 1 is a perspective view of a first embodiment of the flashing of the present invention.

FIG. 1 shows a first embodiment of the present invention. Flashing 10 is a one-piece component having an upper panel 11 and a lower panel 12. The flashing 10 extends along a longitudinal axis 13, which is indicated in FIG. 1 by a dashed line. The embodiment of flashing 10 shown if FIG. 1 extends about 10 feet along the longitudinal axis. However, flashing 10 is made in any desirable length in other embodiments.

The upper panel 11 and lower panel 12 are arranged at an angle 15 with respect to one another. In the embodiment shown in FIG. 1, angle 15 is about 90°. Angle 15 between the upper and lower panels varies from one embodiment to another. Angle 15 is preferably between about 75° and about 115°. In even more preferable embodiments, angle 15 is between about 80° and about 105°. In the most preferable embodiments, angle 15 is between about 85° and about 95°. In other embodiments, the angle 15 is selected, in connection with the degree of flexibility of the material of the flashing 10, for use with roofs of different pitches. For example, embodiments of the present invention may be used at roof/wall joints on roofs having 4:12 pitch, 3:12 pitch, 2:12 pitch, 1:12 pitch, ½:12 pitch, Mansard roofs, and any other suitable roof pitch known to those of skill in the art.

Flashing 10 includes a first protrusion 14 that protrudes from the upper panel 11. Upper panel 11 has a first upper surface 16 from which the first protrusion 14 protrudes. In the embodiment shown in FIG. 1, the first protrusion 14 extends in a continuous fashion along the longitudinal axis 13 for the entire length of the flashing 10. In the embodiment shown in FIG. 1, the first protrusion 14 functions as a guide to assist with the installation of siding or another type of wall covering over the top part of the upper panel 11. The first protrusion provides a guide for aligning the siding at a consistent height above the wall/roof joint while the piece of siding is fastened by the worker to the wall. In the embodiment shown in FIG. 1, the protrusion 14 as a substantially horizontal portion 17 that enables the protrusion to—guide installation of a piece of siding or other wall-covering. In the preferred embodiment, the horizontal portion 17 is angled so that it will not collect water. For example, the plane of the substantially horizontal portion 17 makes an angle of about 76° with the plane of the upper panel 11. This helps prevent water collecting on the protrusion and being wicked up the wall behind the wall covering.

In the embodiment shown in the figures, the first protrusion 14 is located on the upper panel 11 at approximately one third of the distance from the lower panel to the upper panel. This location is varied in other embodiments according to the needs of the builder.

The protrusion 14 has substantially the shape the letter "L" in the embodiment shown. The lower portion 18 of the protrusion 14 extends downwardly from the horizontal portion 17. The lower portion 18 serves multiple purposes, a first of which is to provide increased strength and structural integrity to the protrusion 14. The additional strength provided by the lower portion 18 helps the horizontal portion 17 be maintained at a consistent position along the length of the flashing 10.

Secondly, the lower portion 18 of the protrusion 14 helps prevent the intrusion of water wicking up the upper panel 11 and behind the siding or wall covering. The lower portion 18 improves the ability of the protrusion 14 to seal out water.

Although the protrusion 14 is shown as a single, continuous feature along the entire length of the flashing 10 in FIG. 1, in other embodiments, the first protrusion 14 is implemented in the form of a plurality of discrete protrusions. Such collection of protrusions also extend along the longitudinal axis 13 of the flashing 10, so as to provide the guide and shelf functions of the protrusion 14, but do not provide a single, unbroken feature.

Similarly, the protrusion 14 has different shapes in different embodiments. For example, in some embodiments, the protrusion has substantially the shape of a capital letter "J." Other shapes are used in other embodiments.

Flashing 10 also includes a second protrusion 19 that protrudes from the lower panel 12. In the embodiment shown in FIG. 1, the protrusion 19 substantially has the shape of the letter "T" in capital form when viewed from the side (i.e., along the longitudinal axis 13). The protrusion 19 has a slightly modified shape in other embodiments, such as "T" "ᒣ" "ᒣ" "ᒣ" "ᒣ" "ᒣ" "ᒣ", "Y", and "ᒣ". The protrusion 19 protrudes from a first surface 20 of the lower panel 12. In the embodiment shown in FIG. 1, the protrusion 19 is located approximately 6/7ths of the distance along the surface 20 between the upper panel 11 and a long edge 21 of the lower panel 12. The location of protrusion 19 is different in other embodiments and varies based on the particular installation, including the type of roof covering to be used on the structure.

The top portion 22 of the protrusion 19 provides a large surface area for supporting a shingle or other roof covering. The relatively large surface area helps prevent the shingle or other roof covering from being cracked, broken or otherwise compromised by the protrusion 19. The lower portion 42 of the protrusion 19 is, in some embodiments, flexible enough that the protrusion can be bent or compressed to some degree under a shingle or roof covering. In the embodiment shown in the drawings, however, the protrusion 19 is rigid. Whether or not the protrusion 19 is flexible, it provides improved protection to the roof from water intrusion. The lower panel 12, upper panel 11, and the protrusion 19 form a drain pan-like structure that collects water, prevents the water from running underneath the shingles or roof-covering, and permits proper draining of the water.

Both the upper and lower panels include, in the embodiment shown in FIG. 1, holes 23 for accepting a nail or other fastener for fastening the flashing 10 to a wall and/or roof. In this embodiment, the holes are oblong to permit better adjustment of the position of the flashing as it is installed.

Figure 2:
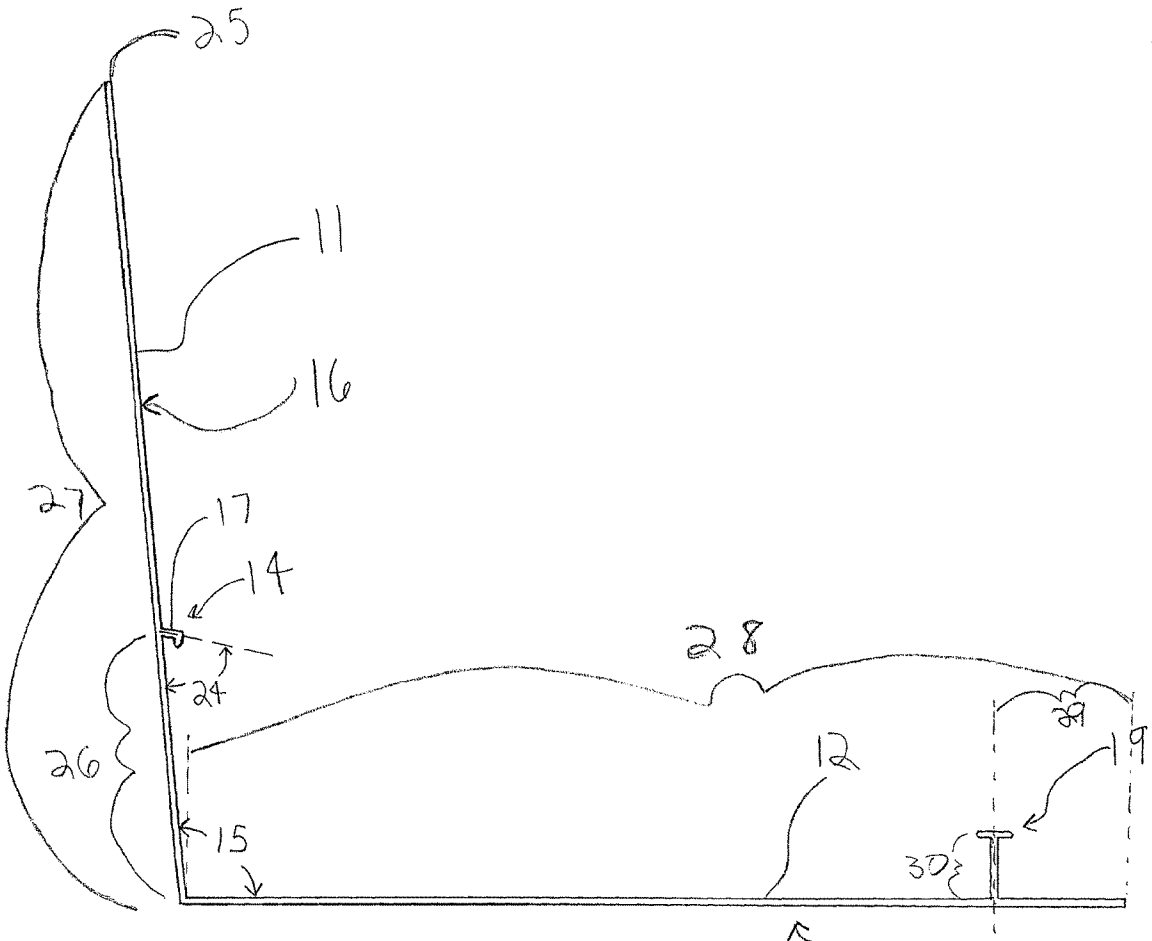
FIG. 2 is a side view of the flashing shown in FIG. 1.

FIG. 2 shows the flashing 10 of FIG. 1 in a side view. The protrusion 14 is disposed such that its horizontal portion 17 forms an angle other than a 90° angle with the surface 16 of the upper portion 11. In this embodiment, the angle 24 between the horizontal portion 17 and the surface 16 is approximately 76°. In other embodiments, the angle 24 is between about 70° and about 80°. In other embodiments, the angle 24 is between about 73° and about 79°.

FIG. 2 also shows that the protrusion 14 is located on the upper panel 11 at approximately one third of the distance from the lower panel 12 to a first edge 25 of the upper panel. In the embodiment of FIGS. 1 and 2. The height of the upper panel 11, represented by 27, is approximately 6 inches and the distance 26 of the protrusion 14 from the lower panel 12 is approximately 2 inches. The width of the lower panel 12, represented by 28, is approximately 7 inches while the distance 29 that the protrusion 19 lies from the edge 21 is approximately 1 inch. The height 30 of the protrusion 19 is approximately 0.375 inches. The protrusion 14 protrudes approximately 0.188 inches from the surface 16. Again, these dimensions are those of the exemplary embodiment only and vary from one embodiment to the next according to the requirements of the manufacturer and/or installer of the flashing.

In the embodiment of the invention shown in the figures, the flashing is constructed of a polymer plastic material. The flashing, including the upper and lower panels and the first and second protrusions, is a single unitary piece. In an advantageous embodiment, the flashing is extruded by a melt extrusion process. As is known in the art, such a process generally involves melting raw plastic pellets and forcing the melted plastic through a die. The extrusion product is then cooled so that it hardens into the shape created by the die. Flashing made by this method can be made into virtually any desirable length. Other suitable manufacturing processes are employed in other embodiments, such as injection molding.

The material used in the most advantageous embodiments of the present invention is flexible and completely waterproof. The most advantageous polymers for this application do not degrade significantly with time. Such advantageous polymers include additives to increase the material's resistance to breakdown due to exposure to ultraviolet (UV) light.

In the embodiment shown in the figures, the extruder die used to extrude the flashing is arranged such that the portion of the die that forms the upper panel is at an angle of approximately 45° with respect to the portion of the die that forms the lower panel. As the material of the flashing cures however, the angle increases such that the final, resting angle between the panels is approximately 90°. Different extruder die designs and different material compositions will result in different final resting angles between the panels. Those of ordinary skill in the art can select the appropriate angle for their intended application of the flashing as desired.

In the advantageous embodiment shown in the figures, the flashing is constructed using a polypropylene-based composition in the thermoplastic elastomer olefinic chemical family. The composition includes polypropylene, a styrene ethylene butylene styrene copolymer, calcium carbonate, antioxidant/stabilizer, and mineral oil. A colorant is also added to provide the desired appearance of the flashing and to enhance the UV breakdown resistance of the flashing. Pigments and other fillers are generally encapsulated in the resin so as to avoid any hazardous conditions when the material is processed.

The embodiment of the flashing shown in the figures is made using a material that will not show evidence of visible cracks after exposure to ozone pressure of 100 mPa and a temperature of 104° F. for 70 hours, pursuant to ASTM Standard D1149-12. Further, the material used in the embodiment of the figures will not show appreciable change in mass or volume after submersion in distilled water at a temperature of 158° F.±2° F. for a minimum of 46 hours, pursuant to ASTM Standard D471-06. Specifically, the material will have a percent change in mass and volume of about 0.00%, respectively.

The material used in the embodiment of the figures also meets the AC286 Section 4.4 standard using the ASTM Standard D412-06 tensile strength and elongation procedure even after weathering for 2000 hours in accordance with ASTM G154. Specifically, the average ultimate elongation of the weathered material exceeds the minimum of 210 percent under SC286 Section 4.4 and the minimum of 85 percent under AC286 Section 4.7 with respect to control specimens. Even more specifically, the material has an average tensile strength of 1530 psi before weathering and an average tensile strength of 1490 psi post-weathering. The material has an average elongation percent of 472% before weathering and 427% post weathering.

The tear strength of the material used in the embodiment of the figures exceeds the minimum of 1.43 pounds per inch pursuant to AC286 Section 4.5 and ASTM Standard D624-12. Specifically, the material has an average tear strength of 733 pounds per inch.

The material used in the embodiment of the figures does not show signs of cracking or brittleness when tested at −40° C. in accordance with AC286 Section 4.6 and ASTM Standard D2137-11. Furthermore, the material meets the tensile strength and elongation requirements of AC286 Section 4.7 even after exposure to Ultra Violet radiation pursuant to ASTM Standard G154-06. In other words, its average ultimate elongation percent exceeds 85% of the average elongation percent of the control specimens.

Advantageously, the material of the embodiment of the flashing shown in the figures is selected to expand and contract in concert with the expansion and contraction of the other building materials around the flashing, such as the roof, wall, shingles, siding, etc. This minimizes the effects of such expansion and contraction on the seals between flashings and the overall strength of the flashing.

Figure 2A:
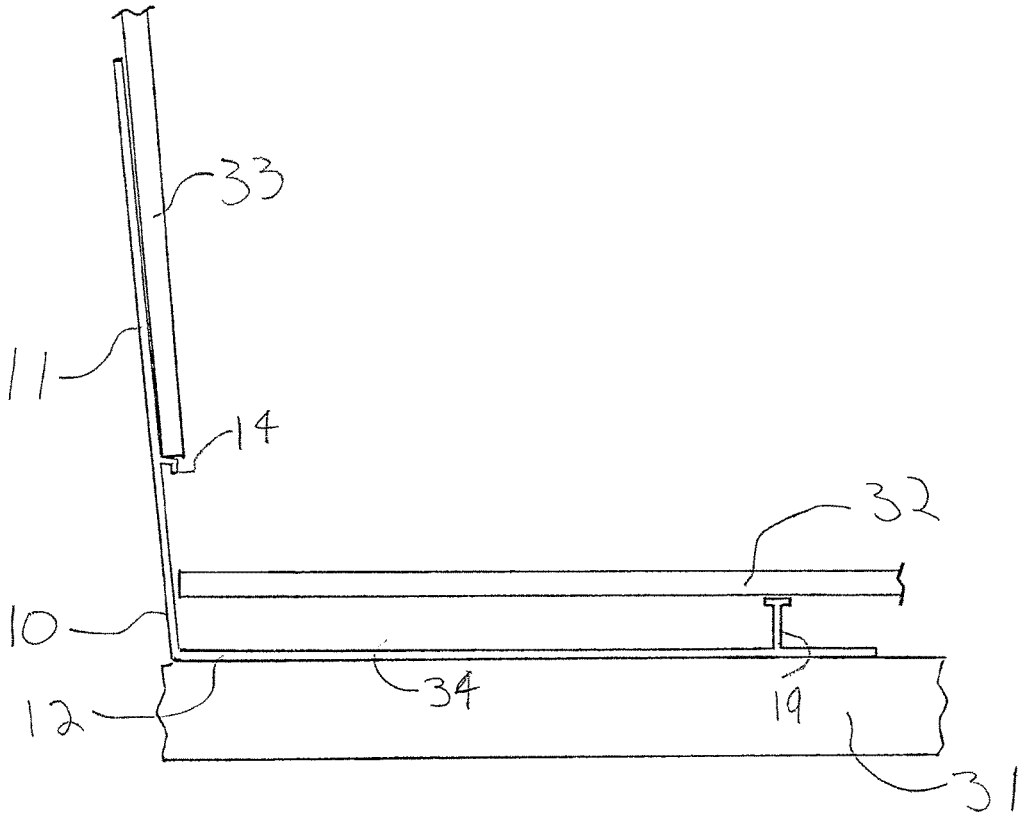
FIG. 2*a* is a second side view of the flashing shown in FIG. 1.

FIG. 2*a* shows another side view of the flashing 10 shown in FIGS. 1 and 2. In FIG. 2*a*, however, a shingle 32 and a piece of siding 33 are shown, along with a roof 31 on which the flashing 10 is installed. The siding 33 is shown installed against the upper panel 11 and is flush with the protrusion 14.

A space 34 remains underneath the installed shingle 32*a*. It is in this space that water that may infiltrate at the roof/wall junction will collect. Given that the roof 31 is almost always set at an angle with respect to the horizontal, such water will drain down the roof. The protrusion 19 prevents such water from running directly onto the roof 31 under the shingles 32.

Figure 3:
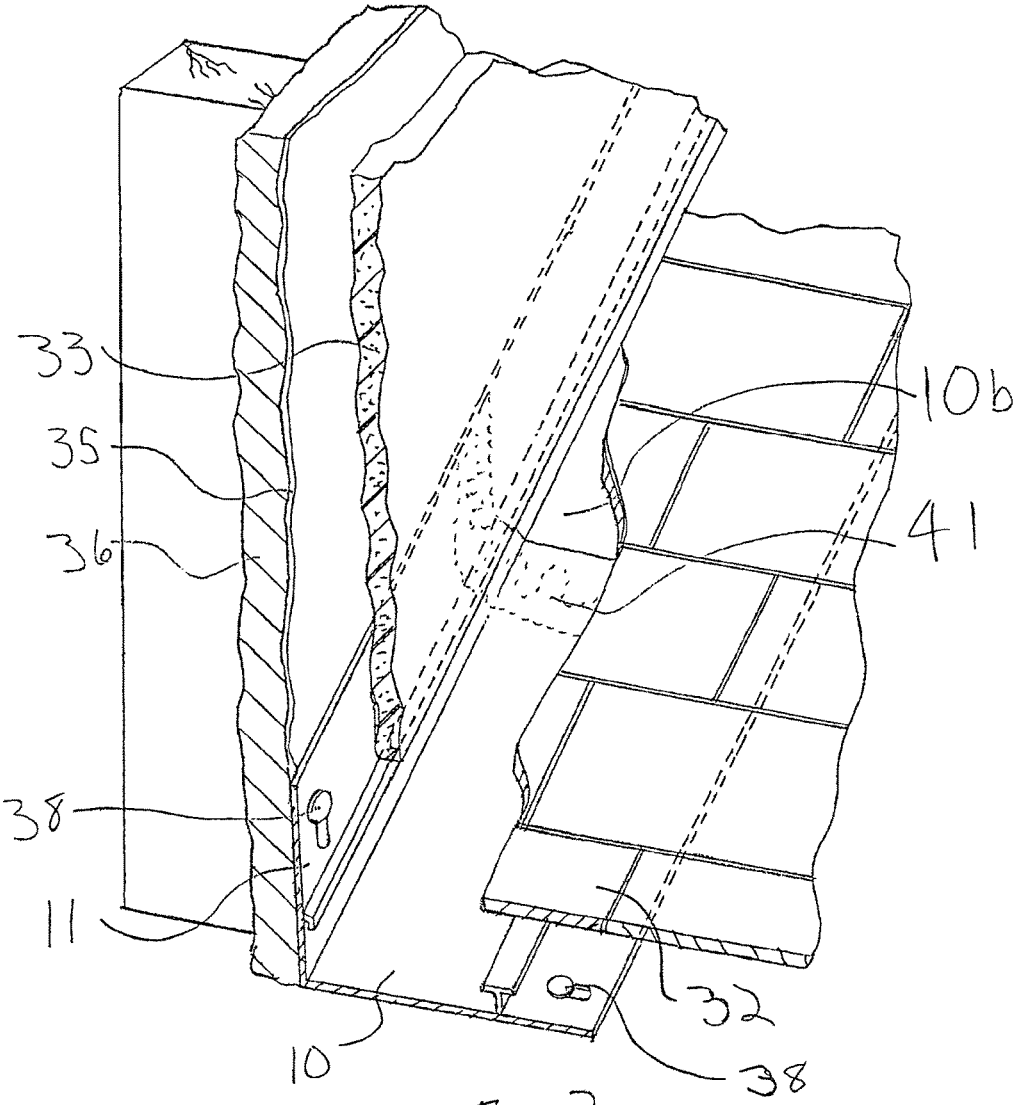
FIG. 3 is a perspective cut-away view of the flashing shown in FIG. 1 that is installed at a roof/wall joint and shown with other building components installed.

FIG. 3 shows the flashing 10 of FIGS. 1, 2, and 2*a* installed at a roof and wall joint. The flashing 10 is fastened to both the wall 36 and the roof by nails 38 driven through oblong holes in the flashing. The wall 36 is covered by a protective layer 35 as is well known in the building industry. A wall covering 32, such as a plurality of shingles is installed over the wall 36 and the upper portion 11 of the flashing 10.

FIG. 3 demonstrates an advantage of this embodiment of present invention—a single piece of flashing can be used along an entire length of the joint even as the length exceeds multiple feet. As a result of its construction using a polymer and the extrusion technique, the flashing is made in a much greater length than traditional flashing. As such, the flashing of this embodiment of the present invention requires far fewer joints between pieces of flashing. When a joint is required, the two pieces of flashing can be joined by the technique of heat welding using a piece of polymer of the same or similar composition. This heat-welded joint remains strong and watertight much longer than a caulked joint between metal flashings. The heat-welded joints require less maintenance and have a much lower risk of failure than traditional caulked joints. As those of skill in the art will appreciate, caulking is an inexact science. Once caulk loses its adhesion to a surface, it can act as siphon and draw water in. FIG. 3 also shows, schematically, a heat welded joint 41 between the flashing 10 and a second flashing 10*b* of the same design. The flashings overlap and, between the two is a heat weld.

The flexibility of the flashing according to the exemplary embodiment shown in the figures also improves the ease and quality of the installation. The flexible flashing is better able to adapt to variations in the wall, roof, or joint between the two. This improves the waterproofing function of the flashing.

Figure 4:
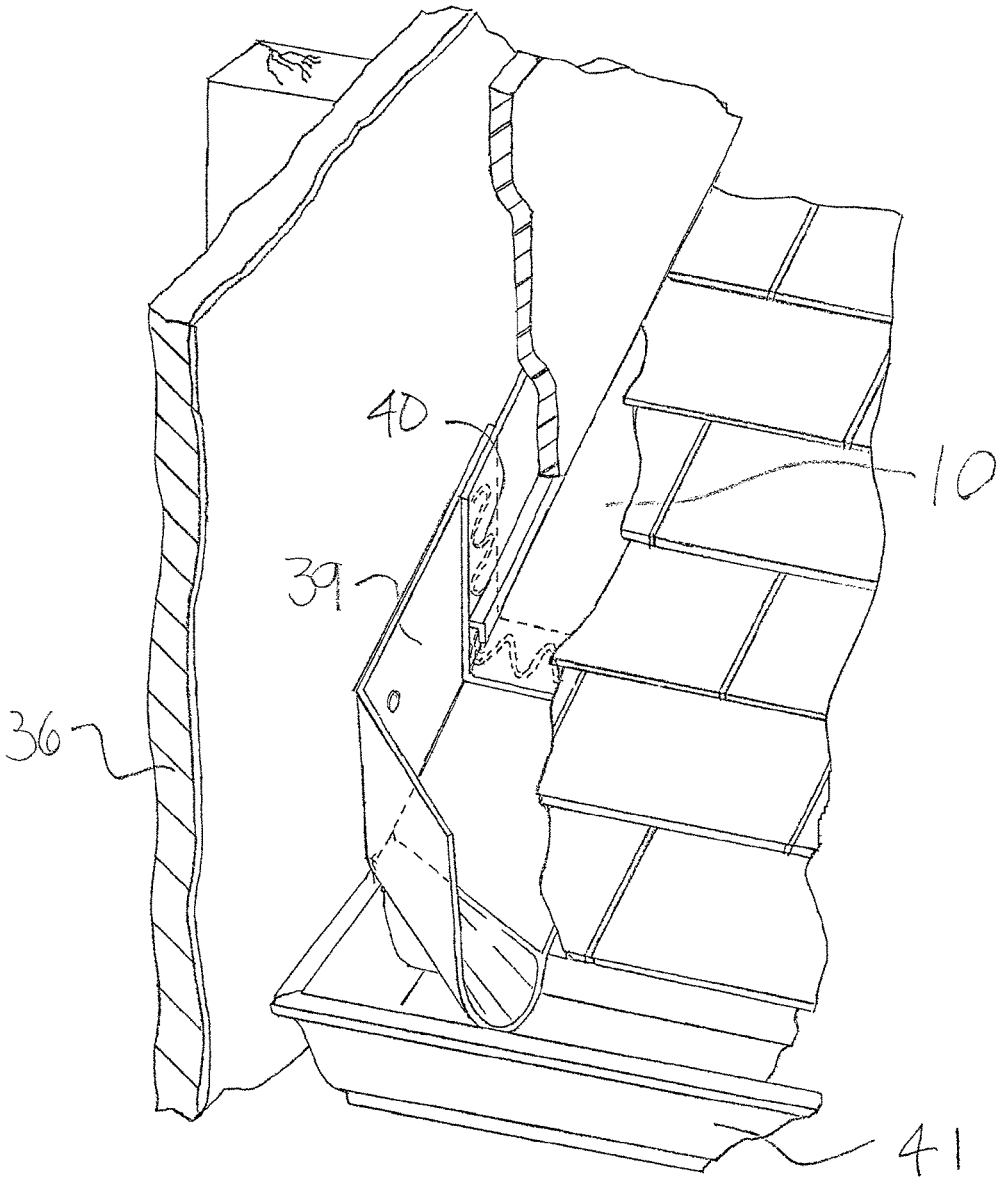
FIG. 4 is a second perspective cut-away view of the flashing shown in FIG. 1 that is installed at a roof/wall joint and shown with other building components installed.

FIG. 4 shows the flashing 10 used in conjunction with "kick-out" flashing 39. Kick-out flashing is used to direct water that is collected and drained off the flashing 10 away from the wall 36. The kick-out flashing can direct the water into a drainage gutter 41.

Also shown in FIG. 4 is a heat weld 40, by which the kick-out flashing 39 is joined to the flashing 10.

The present invention also includes an advantageous method for installing flashing at a joint between a wall and a roof. As described above, multiple pieces of flashing according to the invention can be joined by heat welding to accommodate any length of joint or any feature of the joint such as one or more corners. The flashing, whether in a single-piece or multiple pieces joined together, are then positioned in the joint against the wall and roof. The flashing(s) can then be fastened into place via nails, staples, or any other appropriate fastener. The installer can then apply the wall covering, such as siding, over the upper panel of the flashing using the first protrusion as a guide for the lower-most piece of wall covering. Eventually, the installer will begin applying a roof covering over at least a portion of the lower panel. The flashing of the present invention will work with any type of roof covering, such as asphalt shingles, wood shingles, metal roofing, tile shingles, slate shingles, etc. As also described above, the roof covering will cover at least a portion of said second protrusion.

It will also be understood that patching or repairing the flashing of the present invention is much easier and less expensive than with flashings of the prior art. Should a crack or hole form in the flashing of the present invention, it is relatively straight forward to apply a heat weld patch directly to the affected flashing. Such a repair will provide a consistent surface and will be long-lasting.

While this invention has been described in specific terms related to an exemplary embodiment or embodiments, it will be understood by those of skill in the art that modifications may be made in the configurations and dimensions of those embodiment(s) without departing from the following claims.

What is claimed is:

1. A flashing, consisting of:

an upper panel having a longitudinal axis and a first upper surface;

a lower panel arranged at an angle with respect to said upper panel and having a first lower surface;

at least one first protrusion protruding from said first upper surface of said upper panel; and at least one second protrusion protruding from said first lower surface;

wherein said flashing is formed as a single-piece component;

wherein said first protrusion has substantially the shape of an "L" when viewed along said longitudinal axis;

wherein said first protrusion is located below an upper edge of the upper panel; and wherein said second protrusion has substantially the shape of a "T" when viewed along said longitudinal axis.

2. The flashing of claim 1, further consisting of a plurality of holes in one or more of said upper panel and said lower panel for fastening said flashing to at least one surface.

3. The flashing of claim 1, wherein said first protrusion extends along said longitudinal axis from a first edge of said upper panel to a second edge of said upper panel.

4. The flashing of claim 1, wherein said second protrusion extends along said longitudinal axis from a first edge of said lower panel to a second edge of said lower panel.

5. The flashing of claim 1, wherein said first protrusion forms a ledge and protrudes from said first upper surface at an angle of less than 90°.

6. The flashing of claim 1, wherein said second protrusion is located at about 6/7ths of the distance from said first upper surface to a third edge of said lower panel.

7. The flashing of claim 1, wherein it is formed of a flexible polymer material.

8. The flashing of claim 7, wherein the flexible polymer material has a tensile strength of about 1500 psi.

9. The flashing of claim 7, wherein the flexible polymer material has a tear strength of about 730 pounds per inch.

10. The flashing of claim 7, wherein the flexible polymer material will not absorb any substantial amount of water.

11. The flashing of claim 1, wherein said upper panel and said lower panel are arranged at about a 90° angle.

12. The flashing of claim 1, wherein said flashing is formed using an extrusion process.

13. The flashing of claim 1, wherein said first protrusion is located approximately one third of the distance from the lower panel to the upper edge.

14. A flashing, consisting of:

an upper panel having a longitudinal axis and a first upper surface;

a lower panel arranged at an angle with respect to said upper panel and having a first lower surface; and wherein the first lower surface includes only a single protrusion protruding from said first lower surface having substantially the shape of a "T" when viewed along the longitudinal axis;

wherein the first upper surface includes a second protrusion located below an upper edge of the upper panel;

wherein said flashing is formed of a flexible polymer material; and wherein said flashing is formed as a single-piece component.

15. The flashing of claim 14, wherein said substantially "T"-shaped protrusion is located at about 5/7ths of the distance from said first upper surface to an edge of said lower panel that is substantially parallel to said longitudinal axis.

16. The flashing of claim 14, wherein said second protrusion has substantially the shape of an "L" when viewed along said longitudinal axis.

17. The flashing of claim 14, wherein said second protrusion forms a ledge and protrudes from said first upper surface at an angle of less than 90°.

18. The flashing of claim 14, wherein the flexible polymer material has a tensile strength of about 1500 psi and a tear strength of about 730 pounds per inch.

19. The flashing of claim 14, wherein said second protrusion is located approximately one third of the distance from the lower panel to the upper edge.

* * * * *